US006662770B2

(12) United States Patent
Engesser

(10) Patent No.: US 6,662,770 B2
(45) Date of Patent: Dec. 16, 2003

(54) VALVE ROTATING DEVICE

(76) Inventor: Michael Engesser, An der Krumbeeke 8, 30890 Barsinghausen (DE)

( * ) Notice: Subject to any disclaimer, the term of this patent is extended or adjusted under 35 U.S.C. 154(b) by 0 days.

(21) Appl. No.: 10/239,052

(22) PCT Filed: Mar. 28, 2001

(86) PCT No.: PCT/EP01/03545

§ 371 (c)(1),
(2), (4) Date: Sep. 19, 2002

(87) PCT Pub. No.: WO01/73270

PCT Pub. Date: Oct. 4, 2001

(65) Prior Publication Data

US 2003/0037742 A1 Feb. 27, 2003

(30) Foreign Application Priority Data

Mar. 28, 2000 (DE) ..... 100 15 417

(51) Int. Cl.[7] ..... F01L 1/32

(52) U.S. Cl. ..... 123/90.3; 123/90.28; 123/90.29; 123/188.11

(58) Field of Search ..... 123/90.28–90.3, 123/188.11; 251/88

(56) References Cited

U.S. PATENT DOCUMENTS

| | | | | |
|---|---|---|---|---|
| 2,624,323 A | | 1/1953 | Thorne | |
| 2,775,232 A | | 12/1956 | Witzky | |
| 2,827,886 A | | 3/1958 | Geer | |
| 2,855,913 A | | 10/1958 | Geer | |
| 3,710,768 A | * | 1/1973 | May | 123/90.3 |
| 4,075,987 A | | 2/1978 | Tauschek et al. | |
| 4,227,493 A | * | 10/1980 | Updike | 123/90.3 |
| 5,148,779 A | * | 9/1992 | Okuse et al. | 123/90.28 |

FOREIGN PATENT DOCUMENTS

| | | |
|---|---|---|
| DE | 27 57 455 | 6/1978 |
| DE | 30 04 320 | 8/1980 |
| GB | 1 190 505 | 5/1970 |

* cited by examiner

*Primary Examiner*—Thomas Denion
*Assistant Examiner*—Kyle Riddle
(74) *Attorney, Agent, or Firm*—Oblon, Spivak, McClelland, Maier & Neustadt, P.C.

(57) ABSTRACT

The invention relates to a valve rotator having an annular body in which are circumferentially provided several ball pockets having inclined ball races and in which a ball and a tangential spring are located in each case. In a rest position, the tangential springs press the balls at an upper point of the inclined ball races. An annular cover is also provided, which is rotatable and axially displaceable relative to the body. There is also an axial spring device between the body and the cover, the axial spring device pressing them apart axially in the rest position and if a valve spring tension is applied the body and the cover are pressed axially against one another and the balls roll along the ball races to a lower point. There is a clearly defined rotation between the body and the cover. A drastic reduction of wear is brought about in that the axial spring device is spaced from the balls and on one axial side of the axial spring device is provided a pivot bearing. The balls are in contact with the cover.

9 Claims, 2 Drawing Sheets

VALVE ROTATING DEVICE

Figure 1:
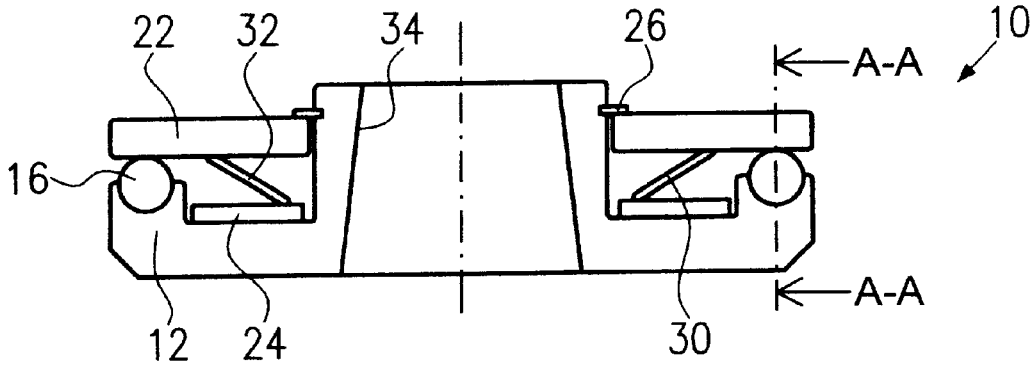

The invention relates to a valve rotator according to the preamble of claim 1.

In internal combustion engines, particularly large diesel engines, the valve seat and valve stem are subject to strong wear. In order to bring about a uniform thermal loading and abrasion, use is normally made of a valve rotator. Rotation additionally ensures the decarbonization of the valve seat.

A valve rotator according to the preamble is known from U.S. Pat. No. 2,624,323. In the latter case a disk spring is spaced from balls, which produce the rotary movement. In order to reduce the frictional forces between the axial spring device and a cover, there is a three-point support with inserted balls on one disk spring side.

In other conventional valve rotators, such as those of DE-AS 1 293 789, U.S. Pat. No. 2,827,886, DE-OS 27 57 455 or 30 04 320, the cover, which is simultaneously the lower valve spring disk, is mounted in rotary manner by means of a disk spring, which rests directly on the balls of the body. When the valve is closed the balls are held by the tangential springs at the upper point of the inclined ball race. If the valve is opened, the disk spring presses on the balls and the latter roll to the lowest point of the inclined ball race in the body. They rotate the disk spring and press together the tangential springs. The rotary movement of the disk spring is transferred via the cover, the valve spring, the upper spring disk and the shims to the valve. If the valve is closed, the disk spring is relieved. The balls are moved back into the starting position again by the tangential springs without rolling.

Although this known valve rotator leads to a good rotation, its service life is limited, since the force introduction of the valve spring force takes place in the case of the known valve rotator via the disk spring and the balls in the body. Thus, both on the balls and on the ball races in the ball pockets considerable wear occurs and this is referred to as pitting. As a result of the function there is also a pronounced deformation, bending and squeezing of the disk spring, particularly if a so-called overpressing occurs when the valve setting is not precise.

The object of the invention is to provide a valve rotator having a simple construction and a good rotation function, whilst at the same time being subject to limited wear.

The invention achieves this object through a valve rotator having the features of claim 1. Preferred further developments of the invention appear in the dependent claims.

A fundamental idea of the invention is to separate from one another in a logical manner the rotation principle and the necessary force introduction and transfer principle. If the valve rotator is compressed, accompanied by the introduction of a valve spring force or tension, the axial spring takes up the essential forces. As a result of the force transfer means constituted by the pivot bearing/axial spring device/cover, the upper part of the valve rotator is frictionally interconnected under the valve spring tension. During a vertical movement, reducing the spacing between the cover and the body, the outer face of the cover rotates the body via the antifriction or roller bearing. This rotation takes place relative to the cover via frictional engagement between the components cover—balls—body. In the case of a load removal these components are separated from one another, accompanied by an increase in the vertical spacing and as a result of the tension of the tangential springs the balls again assume their starting position. Thus, a further rotation of the body can be initiated during the next stroke. The antifriction bearing reduces friction and wear. Through the external arrangement of the balls, their circumferential rolling forces as a result of the relatively large spacing from the rotation axis brings about a high torque, which improves rotation.

It is essential that the spring action and rotation of the rotator are decoupled. As the axial spring device is arranged separately and in spaced manner with respect to the balls, the latter and the ball races are scarcely axially loaded. In this way there is an extensive elimination of pitting formation on the balls and in the ball pockets and consequently wear on the valve rotator. The axial spring device is also no longer exposed to bending, deformation and squeezing forces, which in the case of the known valve rotator occur on the known disk spring. The associated wear phenomena on the disk spring are consequently largely avoided with the valve rotator according to the invention. Compared with the known valve rotator, the valve rotator according to the invention drastically improves the service life, which constitutes an enormous economic advantage, particularly with long-life internal combustion engines. The antifriction bearing has as standard components two bearing track rings between which the rolling elements are located in a cage.

According to the invention the cover is mounted and guided about the rotation axis relative to the body by the antifriction bearing. In the case of an axial displacement of the cover relative to the body, the rotary movement produced is exclusively radially guided by the needle bearing. There is no contact between the cover and the body. For said radial guidance the axial needle bearing has conically positioned bearing track rings or lateral edge shoulders on the two bearing track rings, between which are located the cylindrical, needle-like rolling elements with their cage.

Preferably, according to a further development of the invention, there are three to six and preferably four ball pockets, which are uniformly distributed along the circumference of the body. Compared with conventional valve rotators, according to the invention a much smaller number of balls can be provided, because the individual balls are scarcely loaded or stressed. For a constant number of balls, roughly eight to ten, the ball diameter can be roughly halved, so that it is between 3 and 10 mm. This considerably reduces costs during the manufacture of the body and the ball races therein.

Whereas in the case of the known valve rotator the inclination of the ball races is relatively small, according to the invention it is preferable for the inclination of the ball race of the ball pockets to be uniform and namely between 6 and 15°. As a result of the limited loading of the individual balls in the case of the valve rotator according to the invention, the pre-requisite for a greater ball race inclination is created, so that the rotary movement is improved.

According to a preferred embodiment of the invention, the axial spring device comprises at least one disk spring, preferably a disk spring unit. Disk springs represent a particularly cost-effective possibility of pressing axially apart the cover and the body. When using a disk spring unit the desired axial forces can be inexpensively obtained with high precision.

The pivot bearing located on one axial side of the axial spring device, can be located either on the cover or on the body, the latter being preferred. The pivot bearing can be a simple slideway. However, according to the invention, it is preferable for the pivot bearing to be a needle bearing. In the case of this antifriction bearing variant, in a small construction space there is a particularly low friction rotation between the disk spring supported frictionally on the body on the one hand and the cover on the other.

An overpressing of the valve rotator is inventively prevented in that the balls are completely received in the ball pocket on the lower point of the ball race and that the body in this position engages against the cover. On reaching the maximum axial displacement path, the cover comes up against a block, so that the flux of force is directly passed by the cover into the body. An overstressing of the balls or the axial spring device is consequently prevented, which also has a positive effect on the service life of the valve rotator.

The body is firmly connected to the cylinder head, the cover serving as the lower valve spring disk and is connected in non-rotary manner thereto. However, it is also possible to have a reverse arrangement of the valve rotator according to the invention or a so-called upper arrangement in which the cover forms the upper valve spring disk.

The invention is described in greater detail hereinafter relative to preferred embodiments and the attached diagrammatic drawings, wherein show:

FIG. 1 A diagrammatic cross-sectional view through a valve rotator according to the invention.

Figure 2:
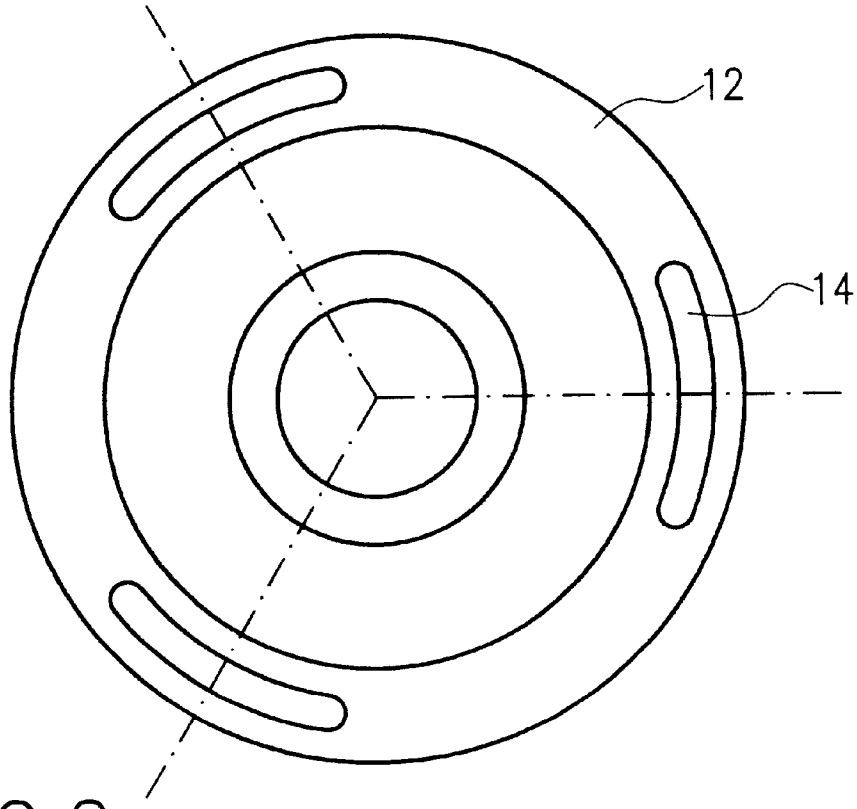

FIG. 2 A diagrammatic plan view of the body of the valve rotator of FIG. 1.

Figure 3:
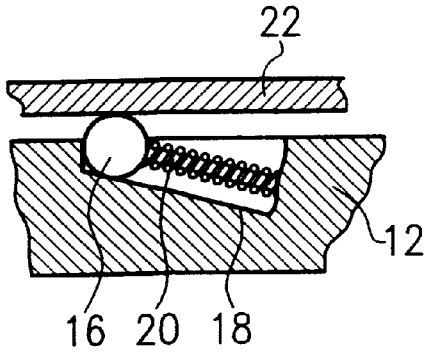

FIG. 3 A detail sectional representation of section A—A of FIG. 1 in the rest position with the valve closed.

Figure 4:
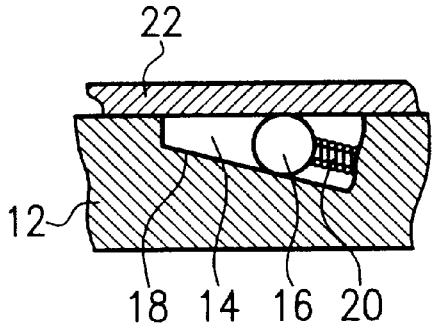

FIG. 4 A detail sectional view along section A—A of FIG. 1 on applying a valve spring tension with the valve open.

Figure 5:
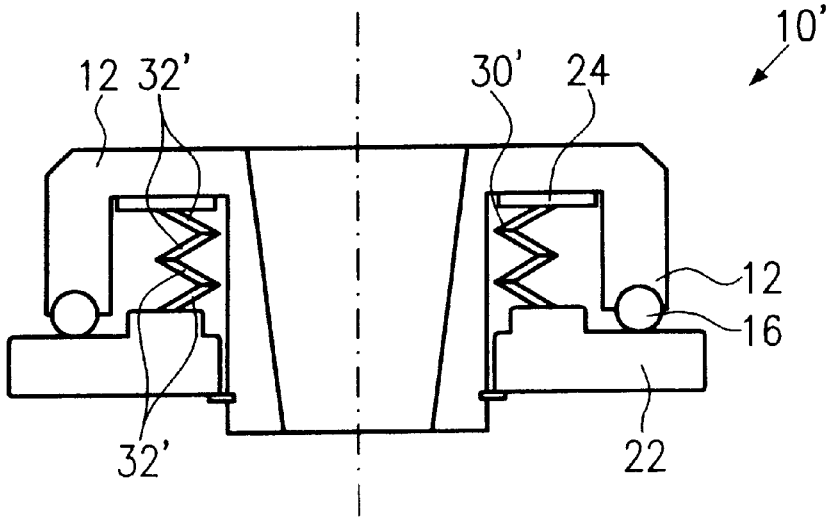

FIG. 5 A diagrammatic cross-sectional view of another embodiment of the valve rotator according to the invention.

According to FIGS. 1 and 2 an inventive valve rotator 10 comprises an annular body 12, which has a central opening with a bevel seat 34 for receiving a valve stem. In its radial ring region a needle bearing is provided as the antifriction bearing 24. On a circumferential shoulder projecting axially over the antifriction bearing 24 are uniformly circumferentially distributed three ball pockets 14, in each of which is placed a ball 16. A ball pocket base is constructed as an inclined ball race 18 on which the ball 16 is held by a tangential spring 20 at an upper dead centre in a rest position.

On the antifriction bearing 24 is provided a single disk spring 32 as an axial spring device 30. The axial spring device 30 is frictionally supported on a disk-like cover 22, which rests on the balls 16. The axial position of the cover 22 relative to the body 12 is defined by a circlip 26, the cover 22 being rotatable relative to the body 12 and is also axially displaceable to a certain extent towards the body 12. Only in said rest state is there a static friction between the cover 22 and the body 12 via the circlip 26. During axial displacement and simultaneous rotation, there is a guidance and consequently a clearly defined position change, exclusively by means of the antifriction bearing 24, which additionally prevents frictional wear.

The function of the valve rotator 10 is illustrated in FIGS. 3 and 4. For opening a not shown cylinder head valves a valve spring is compressed and this exerts an axial force on the cover 22. The cover 22 is displaced axially to the body 12 and, counter to the action of the tangential springs 20, the balls 16 are forced into the ball pockets 14. Whilst the balls 16 in a rest position have a clearly defined projection or overhang with respect to the body 12, as can be gathered from FIG. 3, according to FIG. 4, when spring tension is applied, the ball 16 is completely pressed into the ball pocket 14. The ball 16 rolls on a ball race 18 having an inclination between 6 and 15°, which leads to a clearly defined rotation of the cover 22 relative to the body 12.

With the valve rotator 10 according to the invention the cover 22 moves on block on the body 12, as can be gathered from FIG. 4, so that the maximum displacement path of the cover 22 is limited. A so-called overpressing and therefore damage to the balls 16 or ball races 18 is prevented.

Another preferred embodiment of a valve rotator 10' according to the invention can be gathered from FIG. 5. The essential components of this embodiment correspond to the already described valve rotator 10, so that the correspondingly designated components will not be explained again. Unlike in the previously described embodiment, the axial spring device 30' is constituted by a disk spring unit comprising several disk springs 32' through which it is possible to set a clearly defined, high axial force.

As a result of the valve rotator according to the invention with a separate arrangement of the balls 16 and the axial spring device 30, compared with conventional rotators the balls 16 and ball races 18 are drastically relieved, so that there is a large scale reduction of undesirable deformation on said rotary components in the form of pitting.

What is claimed is:

1. Valve rotator comprising:

an annular body provided in a circumferential direction with plural ball pockets, each ball pocket including inclined ball races and each of which including a ball and a tangential spring, the tangential spring in a rest position holding the respective ball at an upper point of the respective inclined ball race;

an annular cover rotatable about a rotation axis and axially displaceable relative to the annular body;

an axial spring device positioned between the annular body and the annular cover and configured to press the annular body and the annular cover axially apart in the rest position, and, if a valve spring tension is applied, the annular body and annular cover are pressed axially against each other and the balls roll along the ball races to a lower point resulting in a defined rotation between the annular body and the annular cover, the balls being in direct contact with the annular cover and spaced from the axial spring device radially to the rotation axis; and an antifriction bearing provided between the axial spring device and the annular body or annular cover, the antifriction bearing supporting one axial side of the axial spring device, wherein, in a radial direction, the axial spring device is placed on an inside and the balls on an outside and are spaced from one another.

2. Valve rotator according to claim 1, wherein the annular cover is mounted to rotate about the rotation axis and guided relative to the annular body by the antifriction bearing.

3. Valve rotator according to claim 1, wherein three to six ball pockets are provided and are uniformly distributed along the circumference of the annular body.

4. Valve rotator according to claim 1, wherein four ball pockets are provided and are uniformly distributed along the circumference of the annular body.

5. Valve rotator according to claim 1, wherein the inclination of the ball race of the ball pockets is uniform and is between 6 and 15°.

6. Valve rotator according to claim 1, wherein the axial spring device comprises at least one disk spring.

7. Valve rotator according to claim 6, wherein the at least one disk spring includes a disk spring unit.

8. Valve rotator according to claim 6, wherein the antifriction bearing includes a needle bearing.

9. Valve rotator according claim 1, wherein at the lower point of the ball race, the balls are completely received in the ball pocket and the annular body at the lower point engages against the annular cover.

* * * * *